US008565666B2

(12) United States Patent
Hashimoto

(10) Patent No.: US 8,565,666 B2
(45) Date of Patent: Oct. 22, 2013

(54) IMAGE FORMING APPARATUS

(75) Inventor: Naoki Hashimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 13/411,765

(22) Filed: Mar. 5, 2012

(65) Prior Publication Data

US 2012/0243926 A1 Sep. 27, 2012

(30) Foreign Application Priority Data

Mar. 25, 2011 (JP) ..... 2011-067110

(51) Int. Cl.
*G03G 15/00* (2006.01)

(52) U.S. Cl.
USPC ..... 399/401; 399/364; 399/405; 399/397; 399/388; 271/225; 271/185; 271/279; 271/298

(58) Field of Classification Search
CPC ..... B41J 3/546; B41J 3/60
USPC ..... 399/364, 309, 401, 388, 397, 405; 271/301, 291, 185, 225
See application file for complete search history.

(56) References Cited

U.S. PATENT DOCUMENTS

| | | | | |
|---|---|---|---|---|
| 7,840,172 | B2 * | 11/2010 | Yabuta | 399/405 |
| 8,277,041 | B2 * | 10/2012 | Yamamoto | 347/104 |
| 8,335,465 | B2 * | 12/2012 | Tsuchida | 399/381 |
| 8,417,175 | B2 * | 4/2013 | Yamashita et al. | 399/401 |
| 2007/0031170 | A1 * | 2/2007 | deJong et al. | 399/401 |
| 2008/0316245 | A1 * | 12/2008 | You et al. | 347/16 |

FOREIGN PATENT DOCUMENTS

| | | | |
|---|---|---|---|
| JP | 2002-301838 | A | 10/2002 |
| JP | 3597487 | B2 | 12/2004 |

* cited by examiner

*Primary Examiner* — Matthew G Marini
*Assistant Examiner* — Allister Primo
(74) *Attorney, Agent, or Firm* — Fitzpatrick, Cella, Harper & Scinto

(57) ABSTRACT

In an image forming apparatus, a recording medium is fed by being switched between a first conveying path feeding a recording medium to a first image forming portion and a second conveying path feeding the recording medium to a second image forming portion without being enabled to pass through the first image forming portion.

6 Claims, 5 Drawing Sheets

IMAGE FORMING APPARATUS

BACKGROUND OF THE INVENTION

1. Field of the Invention

The present invention relates to an image forming apparatus having an image forming portion based on the electrophotographic system and an image forming portion based on the inkjet system.

2. Description of the Related Art

General conventional methods for obtaining an image include the method based on the electrophotographic system (toner type) and the method based on the inkjet system (ink type). These two methods (recording systems) have their own respective advantages. The electrophotographic system can achieve fast speed, and the inkjet system exhibits excellent ink color reproduction. Apparatuses which selectively use such respective advantages so as to form an image have been proposed.

For example, Japanese Patent Laid-Open No. 2002-301838 implements an apparatus which selectively uses such respective advantages so as to form an image, by disposing an image forming portion based on the inkjet system downstream from an image forming portion based on the electrophotographic system.

However, the conveying path of the recording medium in the conventional image forming apparatus passes through the image forming portion based on the electrophotographic system and then goes to the image forming portion based on the inkjet system. Accordingly, even in a case where solely an image based on the inkjet system is to be formed, the recording medium passes through the image forming portion based on the electrophotographic system. In this case, the recording medium on which an image based on the inkjet system is to be formed passes through also the image forming portion based on the electrophotographic system. This may cause deterioration of the recording medium or the image forming portion based on the electrophotographic system.

For example, when the recording medium is special paper which is differing in type from plain paper, such as an envelope, the recording medium may be wrinkled by the fixing portion in the image forming portion based on the electrophotographic system. Further, when the recording medium is small-sized paper among those applicable sizes, the temperature may rise at part of the fixing portion in the image forming portion based on the electrophotographic system where the recording medium does not pass through. This may cause deterioration.

Further, disposition of the image forming portion based on the inkjet system downstream from the image forming portion based on the electrophotographic system brings about an increase in size of the apparatus, because such an apparatus corresponds to a construction including an image forming portion based on the electrophotographic system, to which an apparatus having an image forming portion based on the inkjet system is added.

SUMMARY OF THE INVENTION

The present invention is directed to prevent deterioration of both the recording medium and the image forming portion based on the electrophotographic system which may otherwise be caused by the recording medium passing through the image forming portion based on the electrophotographic system when solely an image based on the inkjet system is to be formed.

The present invention is further directed to realize a reduction in size of the apparatus having the image forming portion based on the electrophotographic system and the image forming portion based on the inkjet system.

The present invention provides an image forming apparatus including a storage portion which stores a recording medium, a feeder portion which feeds the recording medium stored in the storage portion one by one, a first image forming portion which forms an image with an electrophotographic system on the recording medium fed by the feeder portion, a reconveying path which reconveys the recording medium on which the image has been formed by the first image forming portion to the first image forming portion, a second image forming portion which is provided at the reconveying path to form an image with an inkjet system on the recording medium, a first conveying path which guides the recording medium fed by the feeder portion to the first image forming portion, a second conveying path which guides the recording medium fed by the feeder portion to the reconveying path provided with the second image forming portion without enabling the recording medium to pass through the first image forming portion, and a guide portion which selectively guides the recording medium fed by the feeder portion to the first conveying path and the second conveying path.

According to the present invention, the recording medium is fed by being switched between the first conveying path feeding the recording medium to the first image forming portion and the second conveying path feeding the recording medium to the second image forming portion without being enabled to pass through the first image forming portion. This prevents deterioration of both the recording medium and the first image forming portion based on the electrophotographic system which may otherwise be caused by the recording medium passing through the first image forming portion based on the electrophotographic system when solely an image based on the inkjet system is to be formed.

Further, provision of the second image forming portion at the duplex conveying path for reconveying the recording medium on which an image has been formed to the first image forming portion can realize a reduction in size of the apparatus.

Further features of the present invention will become apparent from the following description of exemplary embodiments with reference to the attached drawings.

DESCRIPTION OF THE EMBODIMENTS

In the following, suitable embodiments of the present invention will exemplarily be detailed with reference to the drawings. Note that dimensions, materials, shapes, and relative positions of constituents described in the embodiments are to appropriately be changed according to the construction and various conditions of an apparatus to which the present invention is applied. Accordingly, the scope of the invention is not limited to those unless otherwise noted.

[First Embodiment] An image forming apparatus according to a first embodiment will be described with reference to FIGS. 1 to 5. In the present embodiment, a full-color image forming apparatus employing the electrophotographic system and the inkjet system is exemplarily shown as the image forming apparatus.

Figure 1:
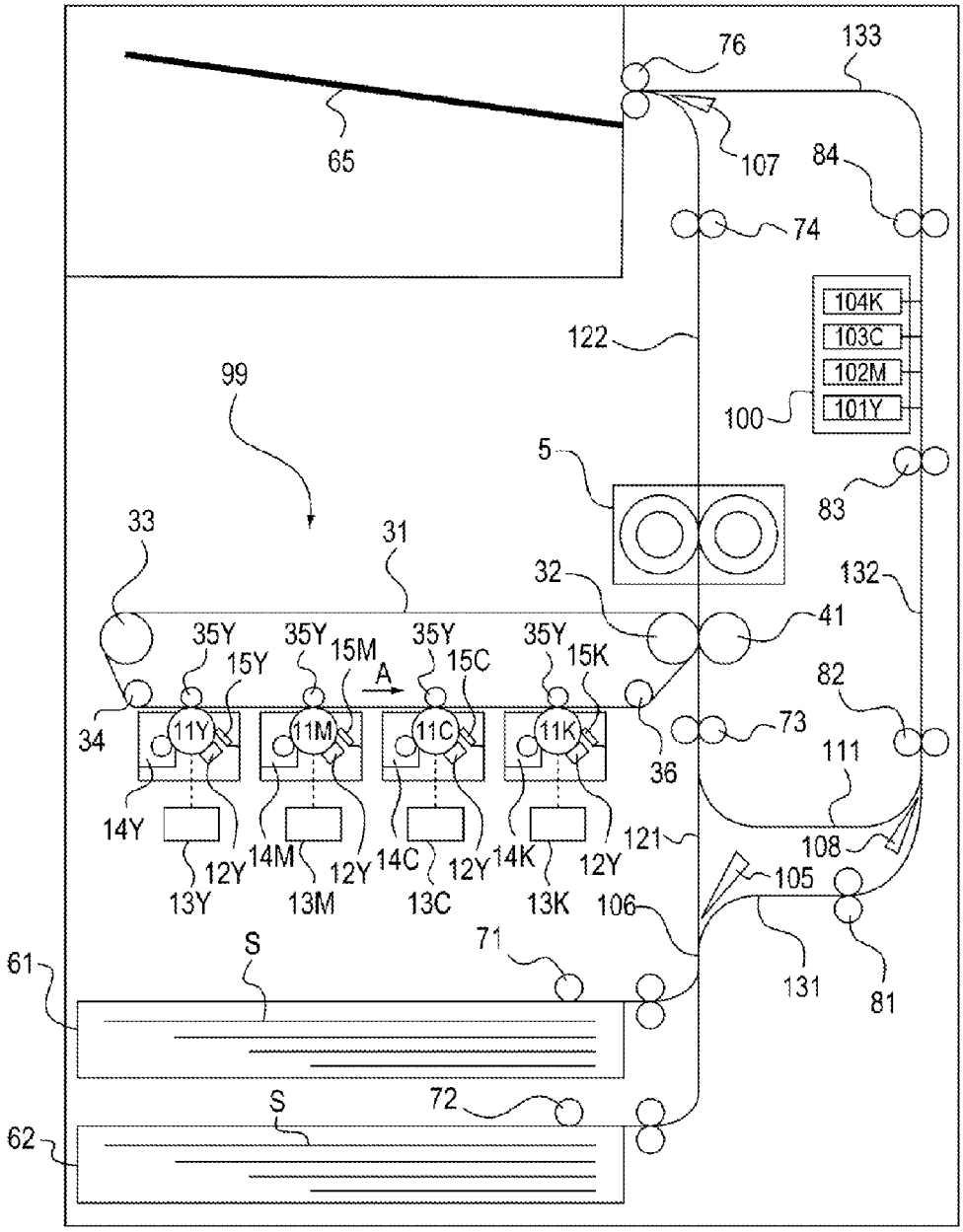
FIG. 1 is a schematic cross-sectional view of an image forming apparatus.

FIG. 1 is a schematic cross-sectional view illustrating a schematic structure of the image forming apparatus according to the first embodiment. The electrophotographic system adopts the intermediate transfer tandem system, in which image forming portions of four different colors are aligned under the intermediate transfer belt. On the other hand, the inkjet system adopts the linear system, in which linear recording portions provided in the direction perpendicular to the sheet conveying direction perform recording.

<Sheet Conveying Process> Recording media S are stored as being loaded in recording medium storages 61 and 62 each being a storage portion. Feeder portions 71 and 72 feed the recording media S one by one so as to adjust to image formation timing. The recording medium S fed by the feeder portions 71 or 72 passes through a conveying path 106 and is guided by a switching member 105 structuring a guide to one of a conveying path 121 being the first conveying path and a conveying path 131 being the second conveying path.

The conveying path 121 being the first conveying path feeds the recording medium S to a first image forming portion 99, which forms an image based on the electrophotographic system. The conveying path 131 being the second conveying path feeds the recording medium S to a second image forming portion 100, which forms an image based on the inkjet system.

The image forming apparatus includes reconveying paths 133, 132 and 111 which reconvey, to the first image forming portion 99, the recording medium S on which an image has been formed by the first image forming portion 99. The second image forming portion 100 is provided at the reconveying paths 133, 132 and 111. The conveying path 131 being the second conveying path conveys the recording medium S to the reconveying paths 133, 132 and 111 where the image forming portion 100 based on the inkjet system is provided.

Subsequently, an image creating process based on each of the electrophotographic system and the inkjet system will be described.

<Image Creating Process Based on Electrophotographic System> The recording medium S guided toward the first image forming portion 99 by the switching member 105 passes through the conveying path 121 being the first conveying path, to arrive at a pair of registration rollers 73. The pair of registration rollers 73 has a function of correcting skew feeding, by creating a loop by hitting the recording medium S conveyed from the recording medium storage 61 or 62 so as to align the leading edge of the recording medium S. The pair of registration rollers 73 also has a function of conveying the recording medium S to a secondary transfer portion at predetermined timing, adjusting to the timing at which an image is formed on the recording medium S, i.e., adjusting to a toner image borne on the image bearing member.

After correcting skew feeding, the pair of registration rollers 73 feeds the recording medium S to the secondary transfer portion at desired timing. The secondary transfer portion is a toner image transfer nip portion for the recording medium S. The secondary transfer portion is formed by a secondary transfer inner roller 32 and a secondary transfer outer roller 41 which face each other. The secondary transfer portion applies a predetermined pressing force and an electrostatic load bias to the recording medium S, to thereby transfer the toner image on the recording medium S.

Next, in connection with the foregoing process of conveying the recording medium S to the secondary transfer portion, a process of forming an image which is fed to the secondary transfer portion at the similar timing will be described.

The image forming portion 99 based on the electrophotographic system chiefly includes an image bearing member and a process portion acting to the image bearing member. Here, the image forming portion 99 provides for four sets, i.e., yellow (Y), magenta (M), cyan (C), and black (K). It goes without saying that the number of colors is not limited to four, and the arrangement order of the colors is not limited thereto.

The image forming portion includes a photoconductor 11 (11Y, 11M, 11C, 11K) as the image bearing member, a charger device 12 (12Y, 12M, 12C, 12K) as the process portion, an exposure device 13 (13Y, 13M, 13C, 13K), a developing device 14 (14Y, 14M, 14C, 14K), a primary transfer unit 35 (35Y, 35M, 35C, 35K), and a photoconductor cleaner 15 (15Y, 15M, 15C, 15K).

The rotating photoconductor 11 has its surface previously charged evenly by the charger device 12. The exposure device 13 is driven relative to the rotating photoconductor 11 based on a transmitted image information signal, to form a latent image. The electrostatic latent image formed on the photoconductor 11 undergoes toner development by the developing device 14, to be visualized as a toner image on the photoconductor 11. Thereafter, the primary transfer unit 35 applies a predetermined pressing force and an electrostatic load bias, whereby the toner image is transferred onto an intermediate transfer belt 31. Thereafter, residual toner slightly remained on the photoconductor 11 is collected by the photoconductor cleaner 15, to be reused in the next image formation.

Next, the intermediate transfer belt 31 will be described. The intermediate transfer belt 31 is suspended by rollers such as a drive roller 33, tension rollers 34 and 36, and the secondary transfer inner roller 32, and driven to convey in the direction A indicated by the arrow. The image forming processes for the colors Y, M, C, K executed in parallel by the image forming portions corresponding to their respective colors are timed so that each of toner images is overlaid on a toner image of an upstream color primarily transferred on the intermediate transfer belt 31. As a result, a full-color toner image is eventually formed on the intermediate transfer belt 31, and conveyed to the secondary transfer portion.

At the secondary transfer portion, the full-color or toner image is secondarily transferred from the intermediate transfer belt 31 onto the recording medium S. Thereafter, the recording medium S is conveyed to a fixing device 5. The fixing device 5 fuses and fixes the toner image on the recording medium S by means of a predetermined pressing force of the opposing rollers or the belt, and a heating effect exerted by a heat source, which is generally a heater.

The recording medium S having the toner image fused and fixed thereon by the fixing device 5 passes through the conveying path 122 and conveyed by a pair of conveying rollers 74. The recording medium S is further conveyed by a pair of discharge rollers 76 to be placed on a discharge tray 65.

Further, from the standpoint of energy saving, the image forming portion 100 based on the inkjet system is configured so as not to operate while the image forming portion 99 based on the electrophotographic system forms an image. This control over the operation is performed by a controller (controller (CPU) 90 illustrated in FIG. 5) which will be described below.

Figure 2:
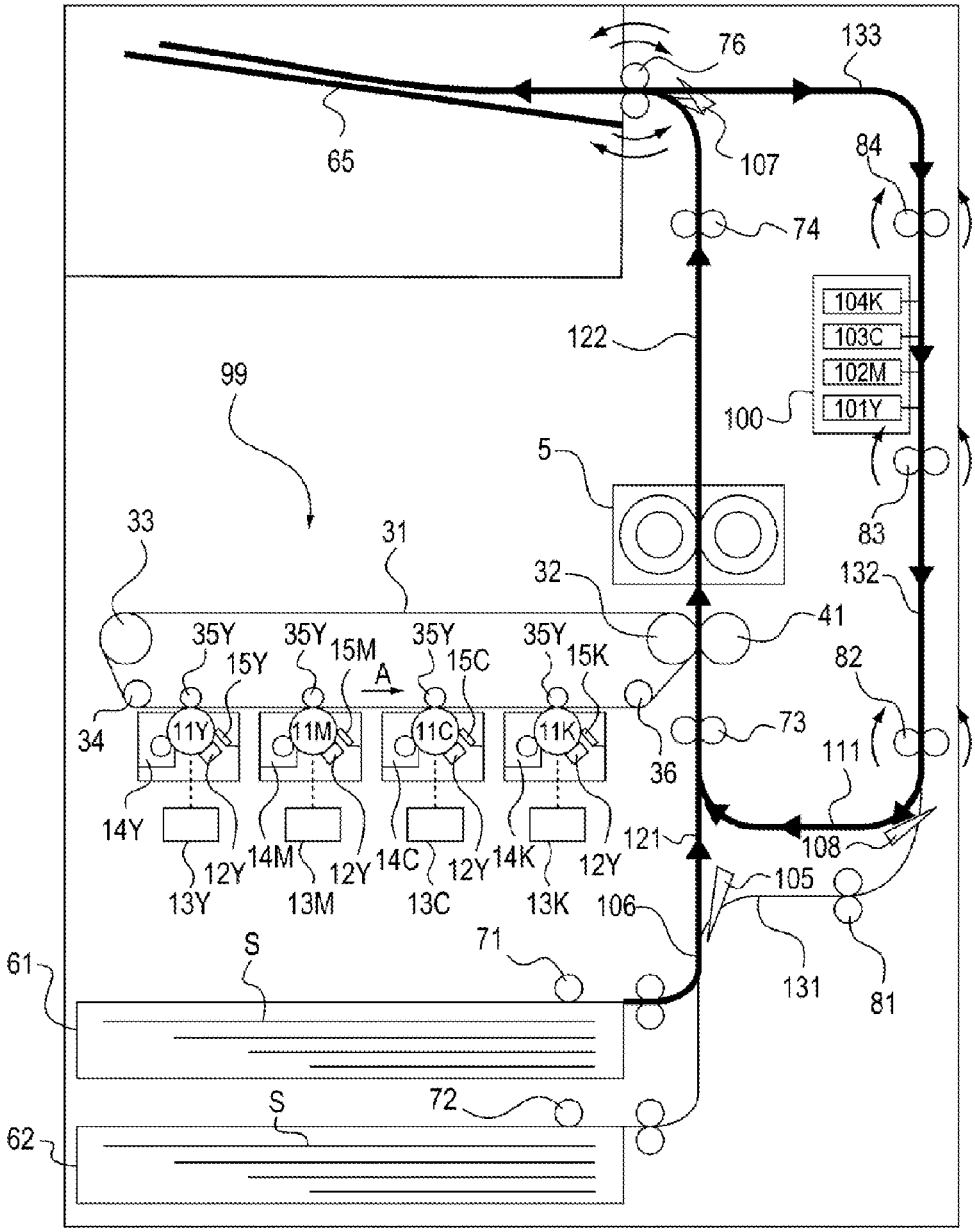
FIG. 2 is a cross-sectional view illustrating duplex image formation based on the electrophotographic system.

<Duplex Image Forming Process Based on Electrophotographic System> Next, duplex image formation on the recording medium S based on the electrophotographic system will be described with reference to FIG. 2.

The recording medium S having a toner image fused and fixed by the fixing device 5 passes through the conveying path 122 and conveyed by the pair of conveying rollers 74, and further conveyed by the pair of discharge rollers 76. The pair of discharge rollers 76 can regularly or reversely rotate, and has a function of reversing the rotation direction at the timing where the rear edge of the recording medium S is nipped.

The pair of reversely rotating discharge rollers 76 reverses and conveys the recording medium S. A switching member 107 conveys the recording medium S to the conveying path 133 which structures the reconveying path. The recording medium S is conveyed by a pair of conveying rollers 84, a pair of registration rollers 83, and a pair of conveying rollers 82 in this order, to be conveyed through the conveying path 132 structuring the reconveying path. Subsequently, the recording medium S conveyed by the pair of conveying rollers 82 is guided to the conveying path 111 structuring the reconveying path by a switching member 108, and arrives at a pair of registration rollers 73. The image forming process which follows has already been described and, therefore, it is not repeated herein.

The recording medium S having the toner images fused and fixed on both sides passes through the conveying path 122, conveyed by the pair of conveying rollers 74, and further by the pair of discharge rollers 76, to be placed on the discharge tray 65.

Figure 3:
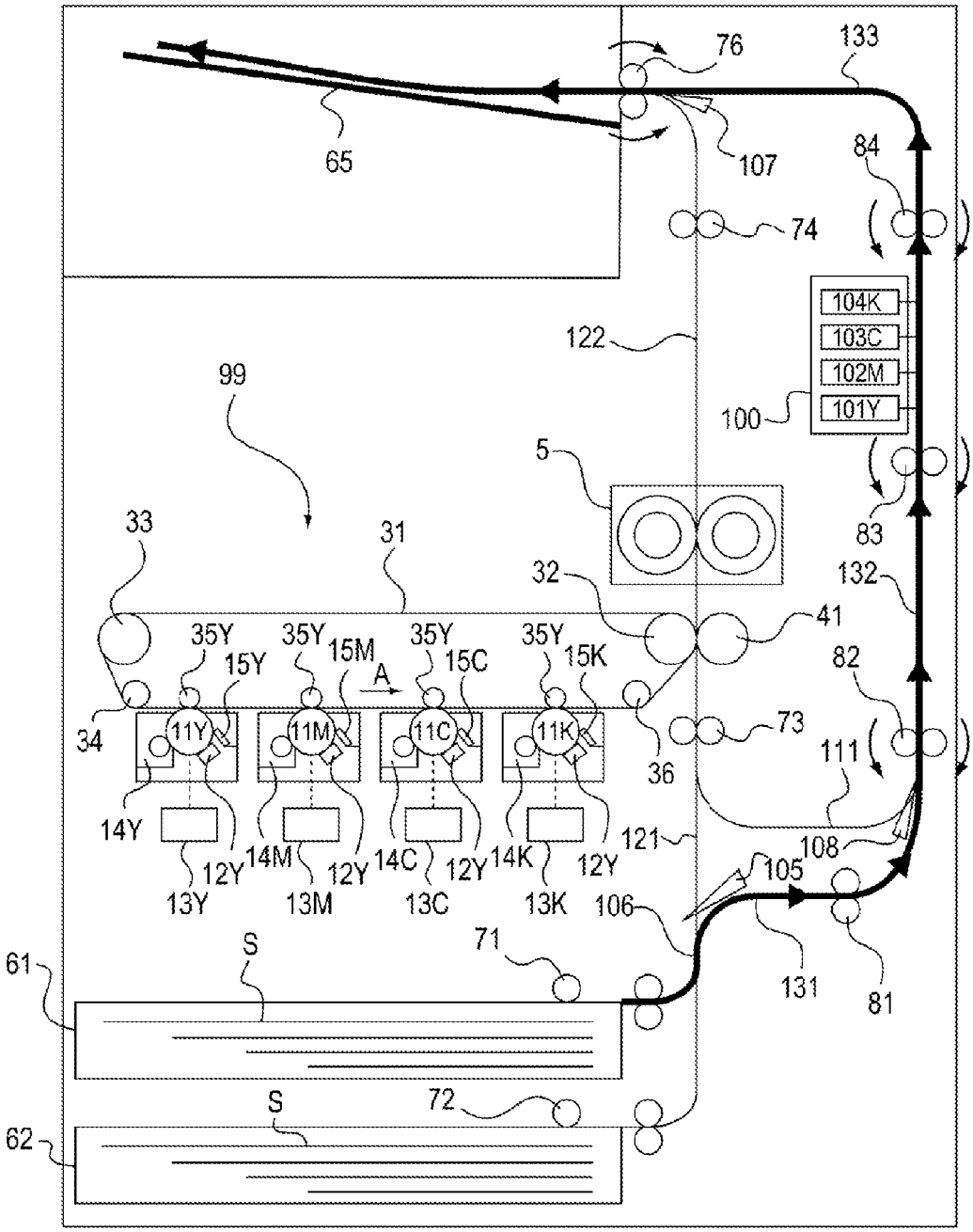
FIG. 3 is a cross-sectional view illustrating single-sided image formation based on the inkjet system.

<Image Creating Process Based on Inkjet System> Next, the image forming portion 100 based on the inkjet system will be described with reference to FIG. 3. The recording medium S guided toward the second image forming portion 100 by the switching member 105 passes through the conveying path 131 being the second conveying path. Then, the recording medium S is fed to the conveying path 132 by the pair of conveying rollers 82, and conveyed to the pair of registration rollers 83.

In the duplex image forming process based on the electrophotographic system, the pair of conveying rollers 82 regularly rotate to thereby convey the recording medium S downward in the drawing. The pair of conveying rollers 82 can switch the rotation direction between regular and reverse rotations. The pair of conveying rollers 82 can reversely rotate so as to convey the recording medium S upward in the drawing when an image is to be formed in the image forming process based on the inkjet system.

Next, the pair of registration rollers 83 has a function of correcting skew feeding, by creating a loop by hitting the recording medium S conveyed from the pair of conveying rollers 82 so as to align the leading edge of the recording medium S. The pair of registration rollers 83 also has a function of conveying the recording medium S to the image forming portion 100 based on the inkjet system at the timing of forming an image on the recording medium S, i.e., adjusting to the ink discharging timing of the image forming portion based on the inkjet system.

It goes without saying that the pair of registration rollers 83 can switch between regular and reverse rotations when an image is to be formed based on the inkjet system as described above.

The image forming portion 100 based on the inkjet system discharges ink according to image information on the recording medium S so as to form an image. The recording portion of the image forming portion 100 has recording heads 101Y, 102M, 103C, and 104K, of yellow (Y), magenta (M), cyan (C), and black (K), respectively, for example.

As shown in FIG. 1, the recording heads 101Y, 102M, 103C, and 104K are line heads based on the inkjet system each having a nozzle row having a length (width) in the direction perpendicular to the conveying direction of the recording medium.

Yellow (Y) ink, magenta (M) ink, cyan (C) ink, and black (K) ink are selectively discharged from the four recording heads 101Y, 102M, 103C, and 104K, respectively, so that a full-color image is recorded on the recording medium S.

The ink to be discharged is supplied from ink cartridges (not shown) through pumps and tubes (both not shown) to corresponding recording heads 101Y, 102M, 103C, and 104K. It goes without saying that the number of colors is not limited to four, and arrangement order of the colors is not limited thereto.

The recording medium S to which ink has been discharged based on the inkjet system is conveyed to the conveying path 133 by the reversely rotating pair of conveying rollers 84. The conveyed recording medium S is conveyed by the pair of discharge rollers 76, to be placed on the discharge tray 65.

As described above, in the present embodiment, when solely an image based on the inkjet system is to be formed, the recording medium is fed to the reconveying paths 133, 132 and 111 where the second image forming portion 100 is provided, without being enabled to pass through the first image forming portion 99 based on the electrophotographic system. This prevents deterioration of both the recording medium and the first image forming portion 99 based on the electrophotographic system which may otherwise be caused by the recording medium passing through the first image forming portion 99 based on the electrophotographic system when solely an image based on the inkjet system is to be formed.

Further, provision of the second image forming portion 100 between the reconveying paths 133 and 132 for reconveying the recording medium having an image formed to the first image forming portion 99 realizes a reduction in size of the apparatus, as compared to a construction where the image forming portions 99 and 100 are serially arranged.

Further, from the standpoint of energy saving, the image forming portion 99 based on the electrophotographic system is configured so as not to operate while the image forming portion 100 based on the inkjet system forms an image. This control over the operation is performed by a controller (controller (CPU) 90 illustrated in FIG. 5) which will be described below.

<Processes Related to Electrophotographic System and Inkjet System> Here, selective use of the electrophotographic system and the inkjet system, including image re-formation, will be described.

Figure 5:
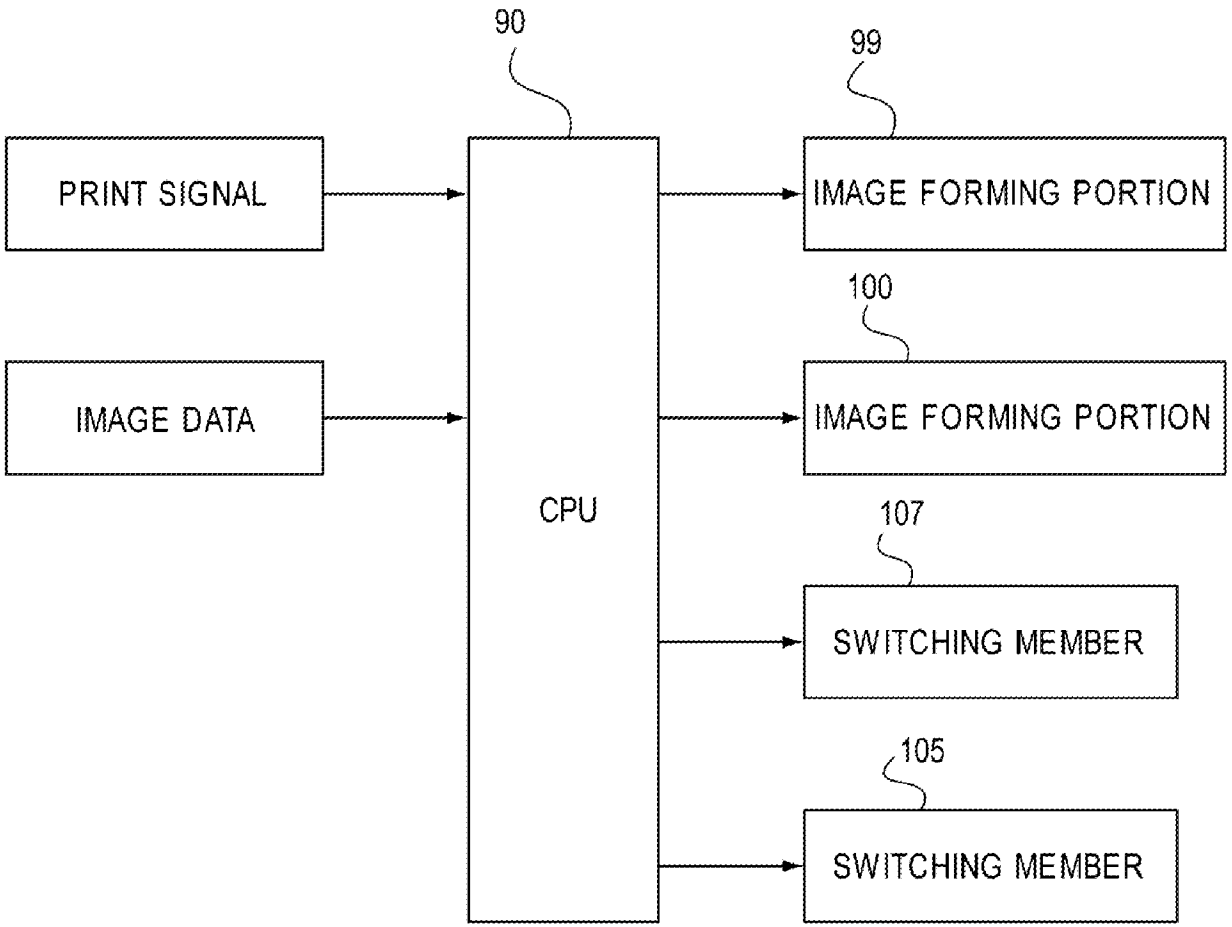
FIG. 5 is a block diagram concerning image formation.

As shown in FIG. 5, the image forming apparatus is provided with a controller 90 as the controller that controls the operations of the entire apparatus. The controller 90 is previously recorded therein as to whether the recording medium S stored in the recording medium storage 61 or 62 matches with: the image forming portion 99 based on the electrophotographic system; the image forming portion 100 based on the inkjet system; or both the image forming portion 99 based on the electrophotographic system and the image forming portion 100 based on the inkjet system.

Exemplary types of paper which match with the image formation based on the electrophotographic system include plain paper, thin paper weighing 64 g or less, and OHP. Exemplary types of paper which match with image formation based on the inkjet system include inkjet coated paper, embossed paper, and envelopes, and in terms of size, small-sized paper which is A4 or less, i.e., A4, B5, LGL, and STMT.

Figure 4:
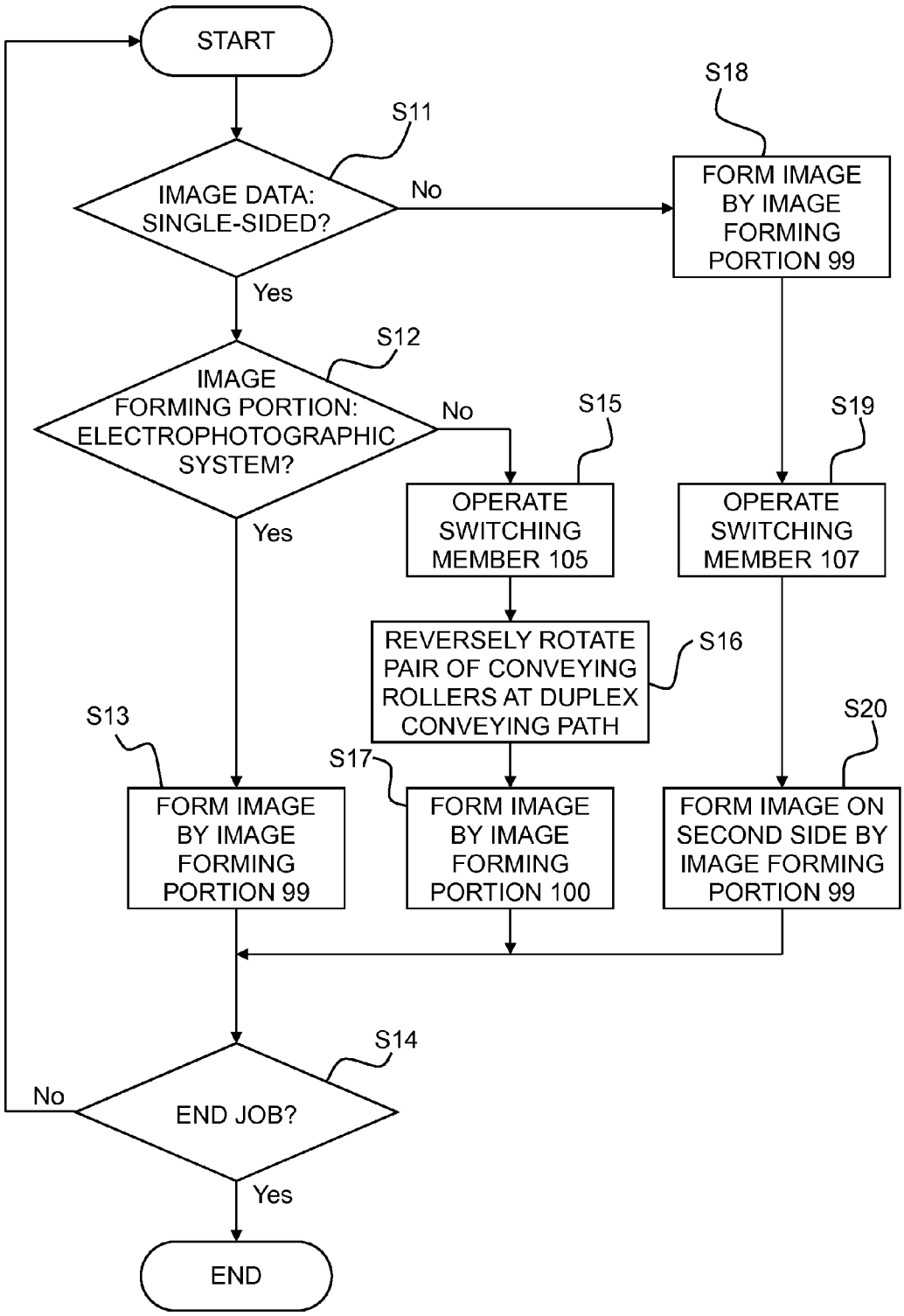
FIG. 4 is a flowchart concerning image formation.

FIG. 4 is a flowchart and FIG. 5 is a block diagram each concerning image formation carried out by selecting the image forming portions according to the recording medium S and image data.

The following is a description of the operation of the controller 90, in a situation where the image forming apparatus receives a print signal and image data from, e.g., an external apparatus, and information on the types of the recording medium entered by the user through an operation portion (not shown).

Note that the information on the types of the recording medium may be entered through a sensor which automatically determines the types of the recording medium stored in the recording medium storage 61 or 62.

When a print signal received from an external apparatus is of a single-sided image (S11), the matching image forming portion is selected out of the image forming portion 99 based on the electrophotographic system and the image forming portion 100 based on the inkjet system.

When the matching image forming portion is the image forming portion based on the electrophotographic system, image data is sent so that the image forming portion 99 based on the electrophotographic system forms an image (S13). On the other hand, when the matching image forming portion is the image forming portion based on the inkjet system, image data is sent so that the switching member 105 operates (S15), the roller pairs on the reconveying path start to reversely rotate (S16), and the image forming portion 100 based on the inkjet system forms an image (S17).

Next, when a duplex image is to be formed, the image forming portion 99 based on the electrophotographic system forms an image (S13). Thereafter, the switching member 107 operates (S19), so that the image forming portion 99 based on the electrophotographic system again forms an image on the second side (S20).

In this manner, the controller 90 controls operations of the first image forming portion 99, the second image forming portion 100, the switching members 105 and 107, based on the information such as a print signal or image data from the external apparatus.

As described above, according to the present embodiment, when solely an image based on the inkjet system is to be formed, the recording medium is fed to the reconveying paths 133, 132 and 111 where the second image forming portion 100 is provided, without being enabled to pass through the first image forming portion 99 based on the electrophotographic system. Accordingly, when solely an image based on the inkjet system is to be formed, the recording medium will not pass through the first image forming portion 99 based on the electrophotographic system. This prevents deterioration of both the recording medium and the first image forming portion 99 based on the electrophotographic system which may otherwise be caused by the recording medium passing through the first image forming portion 99 based on the electrophotographic system.

Further, provision of the second image forming portion 100 between the reconveying paths 133 and 132 for reconveying the recording medium having an image formed to the first image forming portion 99 realizes a reduction in size of the apparatus, as compared to a construction where the image forming portions 99 and 100 are serially arranged.

[Other Embodiment] In the embodiment described above, though four image forming portions (recording portions) differing in color are used for each of the electrophotographic system and the inkjet system, number of pieces and arrangement order are not particularly limited, and should appropriately be set as necessary.

In the embodiment described above, though the construction in which the controller selects the image forming portion to be used according to the type or size of the recording medium is illustrated, the present invention is not limited thereto. For example, what can be employed is a construction in which the user appropriately selects the image forming portion to be used, based on information from an operation portion (not shown) or an external apparatus (not shown) such as a personal computer. The user may be enabled to select to form an image based on the electrophotographic system on the first side of the recording medium, and to form an image based on the inkjet system on the second side. When the user selects to form an image based on the electrophotographic system on the first side of the recording medium and to form an image based on the inkjet system on the second side, the controller 90 enables the following operations. That is, the recording medium is fed from the recording medium storage 61 or 62, so that the recording medium passes the conveying paths 121 and 122 upward. At this time, the image forming portion 99 based on the electrophotographic system does not form an image. Thereafter, when the recording medium is guided to the conveying path 132 to be conveyed downward in the conveying path 132, the image forming portion 100 based on the inkjet system forms an image based on the inkjet system. After the image is formed based on the inkjet system, an image is formed by the image forming portion 99 based on the electrophotographic system on the side of the recording medium opposite to the side where the image has been formed based on the inkjet system, while the recording medium is conveyed upward in the conveying path 122. Note that the type (paper type) or size of the recording medium is not limited to those in the embodiment described above.

While the printer has exemplarily been described as the image forming apparatus in the embodiment described above, the present invention is not limited thereto. For example, the present invention is applicable to other image forming apparatus such as a copying machine or a facsimile machine, or other image forming apparatus such as a multi function peripheral having the combined features of the foregoing machines. Further, the present invention is not limited to an image forming apparatus which uses an intermediate transfer member, to transfer toner images of respective colors in a sequentially superimposed manner on the intermediate transfer member, such that the toner images borne on the intermediate transfer member are transferred to the recording medium at once. For example, the present invention may be an image forming apparatus which uses a recording medium bearing member, to transfer toner images of respective colors in a sequentially superimposed manner to a recording medium borne on the recording medium bearing member. Application of the present invention to such image forming apparatuses provides similar effects.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-067110, filed Mar. 25, 2011, which is hereby incorporated by reference herein in its entirety.

What is claimed is:

1. An image forming apparatus, comprising:

a storage portion which stores a recording medium;

a feeder portion which feeds the recording medium stored in the storage portion one by one;

a first image forming portion which forms an image with an electrophotographic system on the recording medium fed by the feeder portion;

a reconveying path which reconveys the recording medium on which the image has been formed by the first image forming portion to the first image forming portion;

a second image forming portion which is provided at the reconveying path to form an image with an inkjet system on the recording medium;

a first conveying path which guides the recording medium fed by the feeder portion to the first image forming portion;

a second conveying path which guides the recording medium fed by the feeder portion to the reconveying path provided with the second image forming portion without enabling the recording medium to pass through the first image forming portion; and a guide portion which selectively guides the recording medium fed by the feeder portion to the first conveying path and the second conveying path.

2. The image forming apparatus according to claim 1, further comprising:

a conveying portion which is provided at the reconveying path, the conveying portion conveying the recording medium in a first direction so as to reconvey the recording medium on which the image has been formed by the first image forming portion to the first image forming portion, and the conveying portion conveying the recording medium in a second direction opposite to the first direction so as to enable the second image forming portion to form an image on the recording medium having passed through the second conveying path.

3. The image forming apparatus according to claim 1, wherein the first conveying path conveys the recording medium upward, and the reconveying path extends in parallel to the first conveying path.

4. The image forming apparatus according to claim 3, wherein the second image forming portion is provided between the first conveying path and the reconveying path.

5. The image forming apparatus according to claim 4, further comprising a controller which performs control so as to: enable the recording medium fed by the storage portion to pass through the first conveying path; thereafter guide the recording medium to the reconveying path so as to enable the second image forming portion to form an image on the recording medium while the recording medium is passing through the reconveying path; and thereafter enable the first image forming portion to form an image on a side of the recording medium opposite to a side where the image has been formed by the second image forming portion.

6. The image forming apparatus according to claim 1, further comprising a controller which controls an operation of the guide portion so that in a case that the first image forming portion forms an image on the recording medium with the electrophotographic system the guide portion guides the recording medium to the first conveying path, and in a case that the second image forming portion forms an image on the recording medium with the inkjet system the guide portion guides the recording medium to the second conveying path.

* * * * *